United States Patent [19]

Schnaitl

[11] Patent Number: 4,603,859

[45] Date of Patent: Aug. 5, 1986

[54] IMPLEMENT FOR HEAVY ATHLETICS

[76] Inventor: Matthias Schnaitl, Gundertshausen 9, A- 5142 Eggelsberg, Austria

[21] Appl. No.: 657,782

[22] Filed: Oct. 4, 1984

[30] Foreign Application Priority Data

Oct. 6, 1983 [AT] Austria ..... 3542/83

[51] Int. Cl.[4] ..... A63B 21/04

[52] U.S. Cl. ..... 272/142; 272/135; 272/DIG. 5; 272/143; 272/901

[58] Field of Search ..... 272/142, 135, 136, DIG. 5, 272/67, 130; 73/379, 380

[56] References Cited

U.S. PATENT DOCUMENTS 3,563,542 2/1971 Wellman et al. ..... 272/135
4,408,183 10/1983 Wills ..... 272/DIG. 5

FOREIGN PATENT DOCUMENTS 1478056 3/1969 Fed. Rep. of Germany .
1578648 8/1971 Fed. Rep. of Germany .
3038724 5/1982 Fed. Rep. of Germany ..... 272/67

*Primary Examiner*—Richard C. Pinkham
*Assistant Examiner*—Leo P. Picard
*Attorney, Agent, or Firm*—Karl F. Ross; Herbert Dubno

[57] ABSTRACT

An implement for heavy athletics comprises a supporting frame, a tensile element, which is provided with a handle and adapted to be extended against a restoring force, and an instrument for measuring the tensile force exerted on the handle. To permit an exact measurement and the provision of a tensile force-displacement characteristic which is or can be exactly adapted to a given sport, the tensile force is measured by means of an electronic force pick-up, which comprises a force-measuring sensor and is combined with a digital display device. The force-measuring sensor is connected to the handle by means of the tensile element, and the tensile element is extensible against a resistance having a predetermined characteristic.

7 Claims, 4 Drawing Figures

IMPLEMENT FOR HEAVY ATHLETICS

FIELD OF THE INVENTION

This invention relates to an implement for heavy athletics, comprising a tensile element which is provided with a handle and adapted to be extended against a restoring force, and an instrument for measuring the tensile force which is being exerted on said handle.

This invention relates specifically to an implement for heavy athletics which can be used as a training implement for certain heavy athletic contests and for carrying out such contests, particularly contests having a touch of folklore.

BACKGROUND OF THE INVENTION

Laid-open German Application No. 15 78 648 discloses a training implement for a physical exercise which is similar to weight lifting. That implement comprises a rope, which is braked by a friction brake and can be pulled out of a mounting frame. The braking force exerted on the rope can be adjusted with reference to a scale but the tensile force which is actually exerted cannot be exactly determined.

Laid-open German Application No. 14 78 056 discloses a muscle-training implement having one member which is to be moved by hand along a path that is defined by a rail track. The velocity at which that member can be moved is adjustable with reference to a scale. A motor drive is provided, which acts on said member, which is thus subjected to the muscle force that is exerted and the force exerted by the motor. Means are provided for indicating the difference between the total force acting on the member and the measurable motor force. The implement for heavy exercise cannot be used in competition.

Implements for muscle training have been provided, particularly for training the hand and arm muscles. These implements comprise a torsion spring, which has two end legs that extend out of a housing and must be removed toward each other. One leg of the torsion spring is secured to the housing. The other leg constitutes a pointer, which is movable along a scale provided on the housing so that a coarse indication is provided of the force which is exerted on the two spring legs to force them toward each other. An objective measurement of force and an exact determination of the maximum force that has been exerted are not possible.

As has been mentioned above, all known implements of the present kind for heavy athletics are mainly intended for training and can only approximate the exertion of force and motion required in a single actual sport. In the abovementioned implement for weight-lifting training, the force to be overcome is constant and the extent to wich the rope is to be extended depends on the size of the body of the user. In the other implements the force that has been exerted is indicated by the extent to which a member has been moved or by the velocity at which it has been moved. A simulation of any exercise of heavy athletics requires a specific implement, which is designed for that exercise and provided with a separate measuring instrument and with the exception of the lift-training implement most of said measuring instruments depend on displacement and are not sufficiently exact.

OBJECT OF THE INVENTION

The object of the invention is to provide for heavy athletics a novel implement, which with a given basic structure can be adapted to the motions and force exertions required in various sports and permits an exact measurement of the performance of the contestants under identical conditions.

SUMMARY OF THE INVENTION

The implement in accordance with the invention for heavy athletics has an electronic force pick-up including a digital display device for measuring the tensile force and comprises a force-measuring sensor, and the tensile element comprises restoring means opposing the movement of said handle in the direction of the tensile force and adapted to exert on the force-measuring sensor a force which in accordance with a predetermined characteristic depends on the movement of said handle in the direction of said tensile force.

Most of the electronic dynamometers which are used have only a small measuring stroke. Nevertheless the characteristic of the extensible tensile element permits the implement in accordance with the invention for heavy athletics to be adjusted for an actuating sequence which is exactly adapted to the force-displacement function that is performed during a given exercise of heavy athletics, and the force which has actually been exerted is objectively measured by the force pick-up.

A special field of application of the implement in accordance with the invention is the heavy athletic exercise known as finger tugging, which has a touch of folklore. In an actual contest, the two contestants sit on stools on opposite sides of a table and the middle finger of one hand of each contestant is hooked behind a middle finger of the other contestant, or both middle fingers are hooked into a short closed loop of leather, which is called a pulling strap. Now each contestant tries to pull the hand of his opponent beyond a predetermined mark, which in most cases consists of the nearer edge of the table. By means of the implement in accordance with the invention that contest can be simulated in that the handle, which in that case consists in most cases of a pulling hook, simulates the middle finger of the opponent and is placed on a table that is connected to the supporting frame. Only one contestant pulls that hook, by means of a pulling strap, if desired, and the tensile force that is being exerted is measured and indicated. The extension of the tensile element and the resistance by which the tensile element opposes its extension may be selected to match actual conditions. The electronic measuring instrument may consist of a force pick-up comprising a strain gauge or a piezoelectric sensor.

In accordance with a further development the force pick-up, inclusive of the force-measuring sensor are accommodated in a housing, the tensile element extends out of the housing to the handle, and the housing is pivoted to the supporting frame on an axis which is transverse to the direction in which the pulling hook is extensible. In an implement for simulating finger tugging the housing is adapted to be pivotally moved up and down by at least a few degrees about a horizontal axis that is parallel to the top surface of the table so that the actual tensile force will be measured rather than only a component of that force even when the hand is held at different elevations and when the force is exerted by hands differing in size. If a lateral offset of the pulling hand is to be allowed too, the housing may be pivoted also on a vertical axis so that the pulling hook and the tensile element will be exactly adjusted to the actual direction of the tensile force.

The tensile element may comprise a mechanical or pneumatic tension spring or a combination of springs and the characteristic of said spring or springs may be adjustable, if desired. In accordance with a further development, a damper is provided, which brakes the tensile element at least during its retraction when it has been released and preferably also limits the velocity at which the tensile element can be extended. That measure is adopted to provide for a better adaptation to the actual conditions existing during a contest in most sports and to reduce the risk of an injury to the contestants by a tensile element or by the handle which springs back after the handle has been released entirely or in part. The damper may consist of a simple brake, which acts on the tensile element, or of hydraulic or pneumatic dampers comprising a cylinder, in which a piston separates two chambers, communicate only through a small-area orifice at least during the retracting movement of the handle.

In an implement for simulating finger tugging the handle may be connected to the supporting frame above a table. In that case the supporting frame and the table are mounted on a common horizontal supporting plate, which extends beyond the table on the side that is opposite to the supporting frame. A stool may be placed on said supporting plate in front of the table. With that design the implement can be set up at any desired location without a need to fix the supporting frame to the ground. The forces exerted by the contestant on the supporting plate will then balance each other.

The force pick-up may comprise a display device for an erasable indication of the maximum value which has been measured or a maximum memory, the contents of which can be read out via the display device so that the maximum force exerted by a given contestant is indicated. The display may be persistent and may be erased by a separate erase key or may be erased after a predetermined time under the control of a timer. Alternatively, a logic circuit may be used to erase a previous display when the tensile force has decreased below a predetermined value and subsequently increased above a predetermined value.

The evaluating device of the force pick-up may be extended for other contest or training programs. In one embodiment a timer is provided, which measures the time for which a predetermined tensile force, which may be selectable or presettable, had been exerted on the handle, and the measured time is displayed as well as the actually exerted tensile force. It is also possible to measure and display the time for which the maximum tensile force has been exerted. Memory units may be provided for storing the record achieved with the implement and that record is displayed by a separate display device or is read out via the existing display device. The tensile force which is exerted may be represented by a numerical display or, in most cases on display screens, by graphics or pictorial displays, which are controlled by a video computer, which is controlled by the measuring instrument.

If the implement, particularly its tensile element is properly adapted or the characteristic of the tensile element is properly selected, the implement in accordance with the invention may be used for other exercises of heavy athletics too. To simulate the contest known as "arm pushing", the tensile element may be connected to a lever, which simulates the opponent's hand and is pivoted to the table. With a vertically extending tensile element, the implement may be used to simulate weight or stone lifting.

SPECIFIC DESCRIPTION

Figure 1:
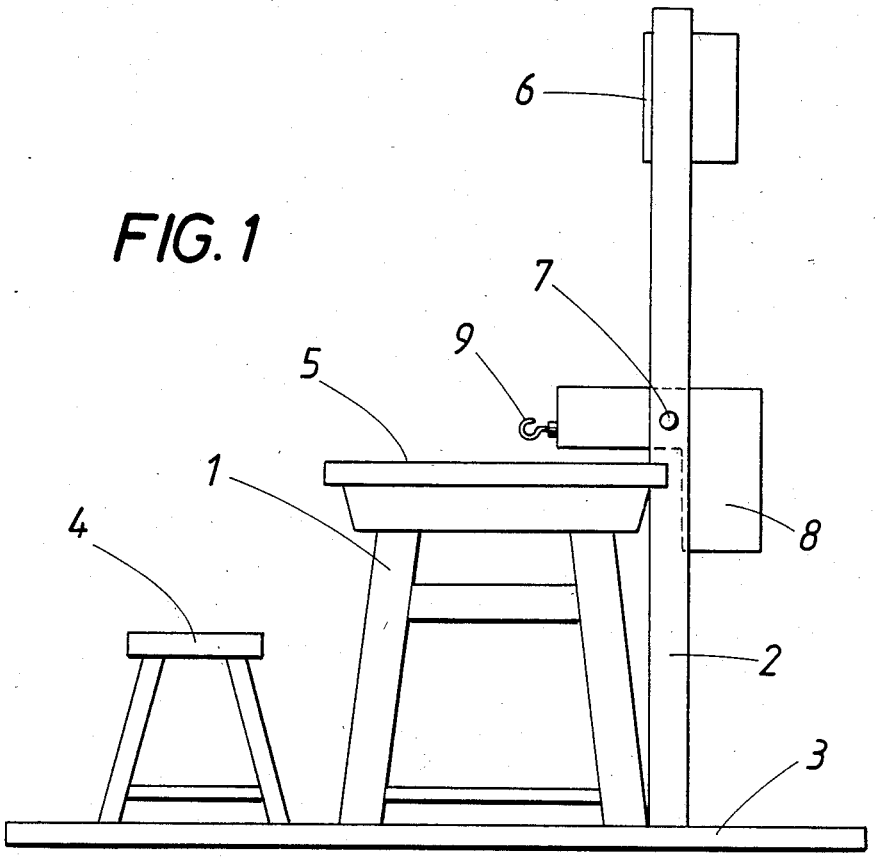
FIG. 1 is a diagrammatic side elevation showing an implement in accordance with the invention.

The implement shown in FIG. 1 is intended for finger tugging. A table 1 for finger tugging is provided and is mounted beside a supporting frame 2 on a horizontal supporting plate 3, which in front of the table has a portion on which a stool 4 can be loosely placed. A contestant takes a seat on that stool 4. The supporting frame 2 is disposed on the opposite side of the table and above the tabletop 5 carries an electronic display device 6, the display field of which faces the free side of the table.

A housing 8 disposed above the table top is pivoted to the supporting frame 2 on a horizontal axis 7. A handle consisting of a pulling hook 9 extends out of the housing 8. The contestant hangs a pulling strap 10 into the pulling hook 9 and hooks his middle finger into that pulling strap 10. The tensile force exerted by the contestant is electronically measured and displayed by the display device 6. The contestant may act with his or her middle finger on the pulling strap 10 on a level which is somewhat above or below the level on which the hook 9 is shown in FIG. 1. In that case the housing 8 will turn on the axis 7 so that a guide rod 12, which is connected to the pulling hook 9 and guided in a bushing 11 in the housing 8, will assume the direction in which tension is exerted.

Figure 2:
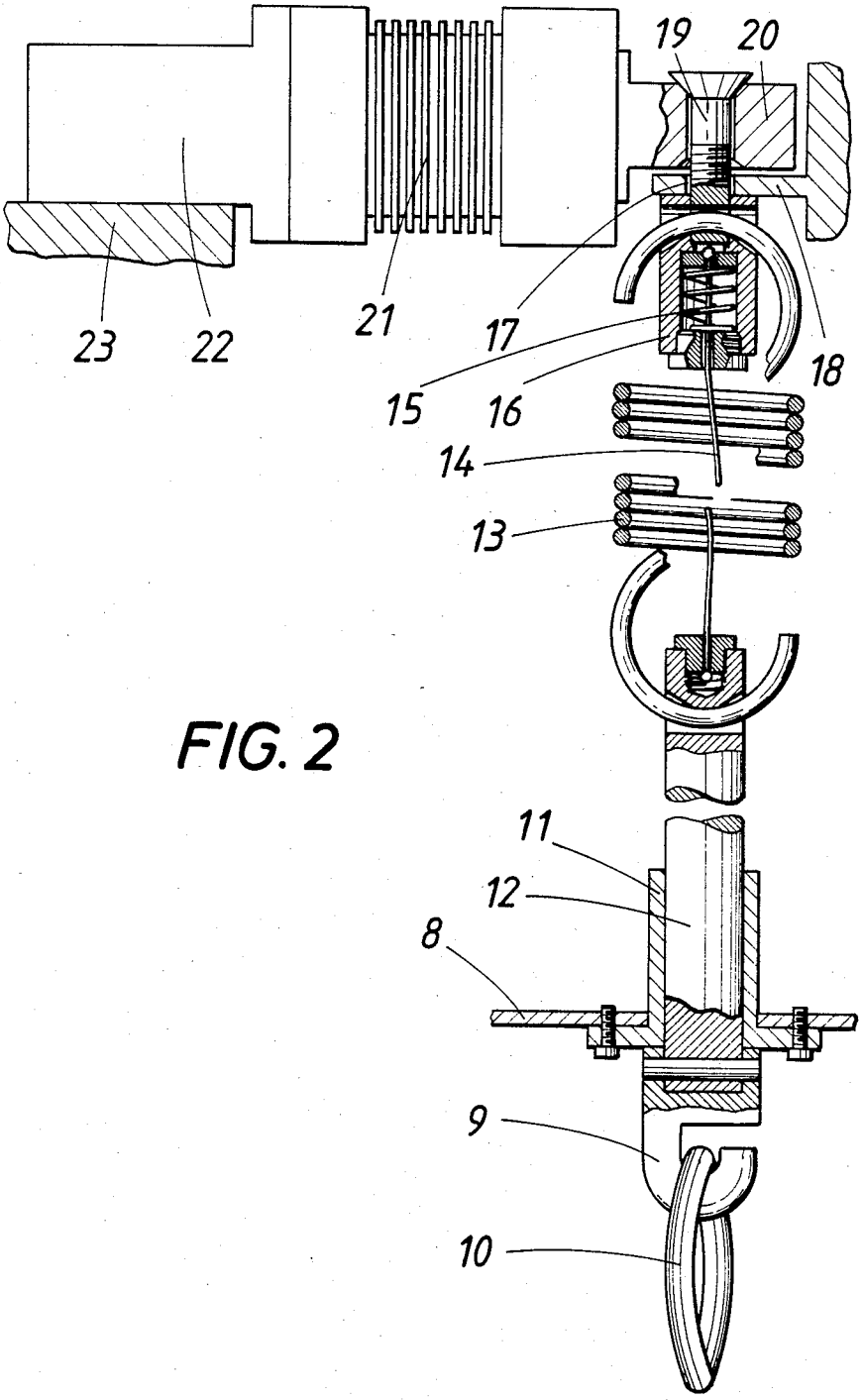
FIG. 2 is a detail showing one way in which the handle and the tensile element may be connected to the force pick-up.

In accordance with FIG. 2, the guide rod 12 is connected to a bushing 16 by a tension spring 13 and by a wire rope 14, which is slack when the tension spring is relaxed and which is supported in the bushing 16 by another spring 15. By means of a screw 19 extending through a bore 17 in a mounting frame 18, the bushing 16 is connected to the end piece 20 of a load cell 21, the other end piece 22 of which is supported by a mounting frame 23 within the housing 8. In dependence on the force acting on the end piece 20, the load cell 21 generates electric signals, which depend on the force acting on the end piece 20, and said signals can be electronically analysed. The load cell 21 contains resistive strain gauges, which are connected in a measuring bridge circuit, or piezoelectric elements.

Figure 3:
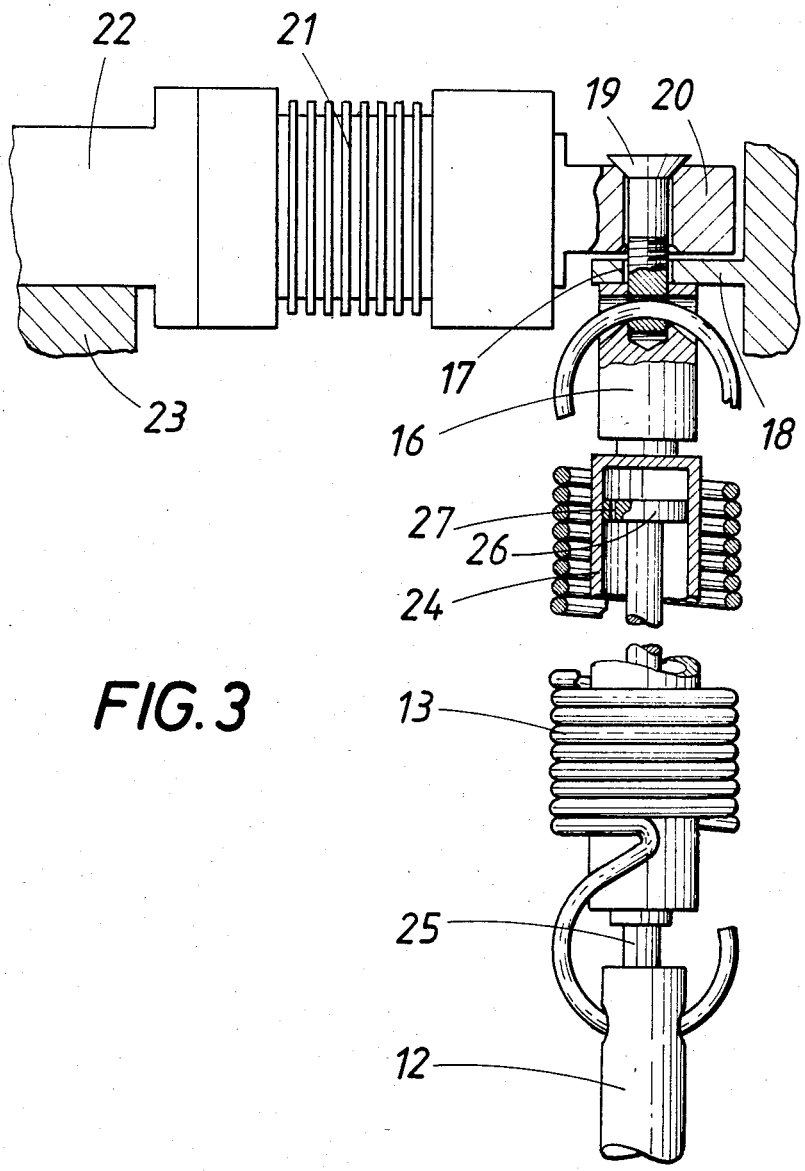
FIG. 3 is a view that is similar to FIG. 2 and illustrates another embodiment of the tensile element.

In the embodiment shown in FIG. 3, the rope 14 and the spring 15 shown in FIG. 2 are replaced by a damper, which is disposed in the spring 13 and connected between the guide rod 12 and the bushing 16 and limits the velocity of the movement in either direction. In the present embodiment, a cylinder 24 is connected to the bushing 16 and is filled with a hydraulic fluid. A piston rod 24 extends out of the cylinder 26 in sealed relation thereto and is connected to the guide rod 12 and carries a piston 26, which is adjustable in the cylinder 24. The piston 26 has an orifice 27 that is small in area relative to the cross-section of the cylinder. The velocity at which the piston 26 is moved and at which the tool 8 is extended just as the velocity at which the previously extended spring 13 contracts when the hook has been released is braked by the damper 24 to 27. A somewhat larger opening 27 might be used and be provided with a hinged plate, which has a smaller orifice and closes during the retracting movement so that different damping factors will be effective during the extending and retracting movements.

Figure 4:
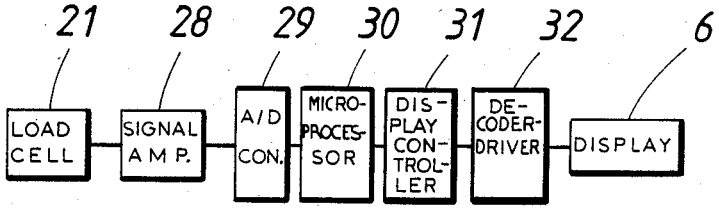
FIG. 4 is a basic block circuit diagram of the electronic part of the implement in accordance with the invention.

As is apparent from FIG. 4, the electronic output terminal of the load cell 21 is connected to a signal amplifier 28, which is succeeded by a analog-to-digital transducer 29. From the latter, a digital signal representing the absolute value that has been measured is delivered to a microprocessor 30, which via a display control device 31 and a decoder-driver 32 controls the electronic display device 6, which will display the tensile force acting on the hook 9 and, if desired, the maximum tensile force exerted during a trial.

I claim:

1. An athletic training and competitive implement which comprises:

a frame;

a housing mounted on said frame;

a rigid elongated tensile element guided in said housing for linear displacement in a given direction parallel to a longitudinal dimension of said tensile element and having one end located externally of said housing and another end disposed internally of said housing;

means for pivotally mounting said housing on said frame for tilting movement about an axis perpendicular to said direction;

means on said one end of said tensile element for enabling same to be tractively displaced by a trainee or a competitor;

a tension-restoring spring in said housing engaging said other end of said tensile element and stretched upon longitudinal extension of said tensile element from said housing in said direction;

an electronic force-measuring sensor in said housing for generating an output signal representing tensile force;

a digital display device electronically connected to said force-measuring sensor for displaying a value of said output signal;

means continuously connecting said spring to said sensor to exert on said sensor a force which, in accordance with a predetermined characteristic, depends continuously on the movement of said one end and thereby enabling said display to continuously depict tensile force generated in said spring and applied to said tensile element; and damping means operatively connected to said tensile elements and extending along said spring for braking movement of said tensile element in a direction opposite to the direction of said tensile force.

2. The implement defined in claim 1 wherein said damping means includes a cable extending through said spring.

3. The implement defined in claim 1 wherein said damping means includes a fluid-filled cylinder containing a piston which separates two chambers in said cylinder and is received in said spring.

4. The implement defined in claim 3 wherein said piston is provided with means defining an orifice which is small in cross section and with means adapted to reduce the flow area of said orifice during movement of said tensile element in the direction of braking movement, said cylinder being filled with a fluid.

5. The implement defined in claim 1, further comprising a table adjacent said frame, said frame extending above said table, said one end of said tensile element being positioned relative to said table at a location such that it can be engaged by a middle finger of a hand resting on the table.

6. The implement defined in claim 5 wherein said frame and said table are mounted on a common horizontal supporting plate so that said frame is disposed at one side of said table and said plate extends beyond said table on an opposite side thereof to receive a seat.

7. The implement defined in claim 1 wherein said sensor is connected to electronic circuitry including means for erasing a display of tensile force which has been exerted, a maximum memory for storing a maximum value of the tensile force which has been exerted, and means for reading out the contents of said memory via said display device.

* * * * *